US012275117B2

(12) United States Patent
Larking et al.

(10) Patent No.: US 12,275,117 B2
(45) Date of Patent: Apr. 15, 2025

(54) ATTACHMENT HUB, BACKUP PAD, AND ABRASIVE DISC

(71) Applicant: 3M INNOVATIVE PROPERTIES COMPANY, St. Paul, MN (US)

(72) Inventors: Paul Larking, Staffordshire (GB); Andrew Robert Henry, Berkshire (GB)

(73) Assignee: 3M Innovative Properties Company, St. Paul, MN (US)

( * ) Notice: Subject to any disclaimer, the term of this patent is extended or adjusted under 35 U.S.C. 154(b) by 685 days.

(21) Appl. No.: 17/415,804

(22) PCT Filed: Dec. 19, 2019

(86) PCT No.: PCT/IB2019/061099

§ 371 (c)(1),
(2) Date: Jun. 18, 2021

(87) PCT Pub. No.: WO2020/128950

PCT Pub. Date: Jun. 25, 2020

(65) Prior Publication Data

US 2022/0040813 A1 Feb. 10, 2022

(30) Foreign Application Priority Data

Dec. 20, 2018 (EP) ..... 18214653

(51) Int. Cl.
*B24B 45/00* (2006.01)
*B24D 9/08* (2006.01)
*B24D 13/20* (2006.01)

(52) U.S. Cl.
CPC ..... *B24B 45/006* (2013.01); *B24D 9/08* (2013.01); *B24D 13/20* (2013.01)

(58) Field of Classification Search
CPC ..... B24B 9/08; B24B 23/005; B24B 23/022; B24B 23/08; B24B 23/02; B24B 41/053;
(Continued)

(56) References Cited

U.S. PATENT DOCUMENTS 3,866,361 A 2/1975 Mauck
4,423,571 A 1/1984 Selander
(Continued)

FOREIGN PATENT DOCUMENTS

DE 102015224225 6/2017
EP 3216561 A1 9/2017
(Continued)

OTHER PUBLICATIONS

International Search report for PCT International Application No. PCT/IB2019/061099 mailed on Apr. 23, 2020, 5 pages.
(Continued)

*Primary Examiner* — Robert F Neibaur

(57) ABSTRACT

The present invention relates to an attachment hub for attachment to a sander, comprising a quick-release attachment assembly configured for releasable and aligned engagement with a counterpart of a backup pad particularly for an abrasive disc. Furthermore, the invention relates to a backup pad having a disc-like shape and comprising a first major surface and a second major surface, the first major surface configured for direct or indirect attachment of an abrasive disc, and the second major surface configured for facing towards an attachment hub for attachment to a sander, and a mounting portion for aligned engagement with an attachment hub of a sander.

13 Claims, 4 Drawing Sheets

(58) Field of Classification Search
CPC ..... B24B 41/04; B24B 41/047; B24D 13/20; B24D 9/08–085
USPC ..... 451/487, 342, 344, 359, 508, 509, 510
See application file for complete search history.

(56) References Cited

U.S. PATENT DOCUMENTS 4,475,316 A 10/1984 Dicke
4,941,790 A * 7/1990 Kirn ..... F16D 1/06 411/432
6,142,858 A * 11/2000 Luedeke ..... B24D 13/20 451/514
6,349,446 B1 2/2002 Krause et al.
6,379,234 B1 4/2002 Mackay
6,523,214 B1 * 2/2003 Kaiser ..... B24B 45/006 451/515
6,743,085 B2 * 6/2004 Fritz ..... B24B 45/006 451/308
6,988,941 B2 1/2006 Saunier
7,575,505 B2 * 8/2009 Lamers ..... B24D 15/00 451/523
8,029,340 B2 * 10/2011 Henning ..... B24B 45/006 451/508
8,607,399 B2 * 12/2013 Umbrell ..... B24D 13/20 279/93
9,242,347 B2 * 1/2016 Krause ..... B24B 45/006
9,561,580 B2 * 2/2017 Chen ..... B24B 45/006
10,807,211 B2 * 10/2020 Montabaur ..... B24B 45/006
2010/0034617 A1 * 2/2010 Liao ..... B24B 45/006 411/432
2014/0045413 A1 2/2014 Breitenmoser
2015/0020369 A1 1/2015 Ryan
2015/0251295 A1 9/2015 Chen
2018/0369981 A1 * 12/2018 Craft ..... B24B 47/12

FOREIGN PATENT DOCUMENTS

TW 201002473 A 1/2010
WO WO01/096067 12/2001
WO 2012083749 A1 6/2012
WO WO2017/220338 12/2017

OTHER PUBLICATIONS

1507 Extended EP Search Report for E18214653.0, PCT/IB2019/061099, Apr. 26, 2019, 3 pages.

* cited by examiner

ATTACHMENT HUB, BACKUP PAD, AND ABRASIVE DISC

CROSS REFERENCE TO RELATED APPLICATIONS

This application is a national stage filing under 35 U.S.C. 371 of PCT/IB2019/061099, filed Dec. 19, 2019, which claims the benefit of European Application No. 18214653.0, filed Dec. 20, 2018, the disclosures of which are incorporated by reference in their entireties herein.

FIELD OF THE INVENTION

The present invention relates to an attachment hub for attachment to a sander, a backup pad, particularly for an abrasive disc, and a system of an attachment hub and a corresponding backup pad.

BACKGROUND ART

Sanders with mounted abrasive discs are frequently used in various types of applications, e.g. in processing of wood or metal. Particularly, in the automotive aftermarket industry the sanding of numerous different substrates in sequence of grades using a single sander is commonly performed.

In conventional sander systems, sander accessories such as abrasive discs are often removed from the sander and discarded before their end of life. For example, an abrasive disc of a desired grade is manually aligned with and attached to a backup pad. The backup pad is attached to a sander. However, due to, e.g., the necessity of using a different grade and thus a different abrasive disc, the abrasive disc is removed from the sander before its end of life.

It is therefore an object of the present invention to provide one or more improved sander accessories that preferably reduce the above-mentioned problems.

SUMMARY OF THE INVENTION

A sander accessory according to the invention is an attachment hub for attachment to a sander. The attachment hub comprises a quick-release attachment assembly configured for releasable, and preferably aligned, engagement with a counterpart of a backup pad particularly for an abrasive disc. Particularly, the backup pad may receive an abrasive disc, which is, via the engagement of the attachment hub with the backup pad and the engagement of the attachment hub with a sander, mounted to the sander. The alignment of the attachment hub and the backup pad may be axially and optionally rotationally. However, it is preferred that only axial alignment is required.

The attachment hub may comprise a hub portion and a frame, the hub portion being adapted for releasable attachment to the sander. The frame may have a truss configuration forming an outer perimeter of the attachment hub. An advantage of the frame having the truss configuration is that it allows dust extraction without requiring rotational alignment with the backup pad. The quick-release attachment assembly may be mounted to the frame.

The quick-release attachment assembly may comprise an actuator, wherein actuation of the actuator results in disengagement of the attachment hub from the counterpart. The actuator may comprise a button, wherein the quick-release attachment assembly is adapted to disengage from the counterpart upon a user pressing the button.

The quick-release attachment assembly of an inventive attachment hub may be configured for axial coupling with the counterpart. The attachment hub may comprise one or more protrusions, one or more recesses configured for rotational coupling of the attachment hub with the counterpart or both.

The axial and the rotational coupling may be effected by different components of the attachment hub. In this case, the one or more protrusions and/or one or more recesses configured for rotational coupling of the attachment hub with the counterpart do not contribute to the axial coupling. Alternatively, the axial and the rotational coupling may be effected by the same components of the attachment hub. In this case, the one or more protrusions and/or one or more recesses configured for rotational coupling of the attachment hub with the counterpart may contribute to the axial coupling.

The quick-release attachment assembly according to the invention may comprise at least one spring member. The spring member may comprise any suitable type of spring, e.g., a spiral spring, a leaf spring, and/or a cantilever spring. The at least one spring member preferably comprises an engagement portion configured for engagement with the counterpart. The at least one spring member may be configured for radial movement, wherein radial outward movement of the at least one spring member causes the quick-release attachment assembly to disengage from the counterpart.

The actuator may be adapted to be moved along an axial direction and the spring member may be adapted to be moved in a radial direction, wherein the movement of the actuator in the axial direction causes the at least one spring member to move in the radial direction. The actuator may comprise a first tapered surface and the at least one spring member may comprise a corresponding second tapered surface that is inversely tapered relative to the first tapered surface, wherein the first and second tapered surfaces are slidable relative to each other so that actuation of the actuator results in a transmission of the actuator's movement in the axial direction into the at least one spring member's movement in the radial direction.

However, other directions of movement of the actuator and/or the at least one spring member are also contemplated. In other words, the actuator may be adapted to be moved along a first direction and the spring member may be adapted to be moved and a second direction, wherein the first direction may be different from the second direction. In this case, the actuator may comprise the first tapered surface and the at least one spring member may comprise the corresponding second tapered surface that is inversely tapered relative to the first tapered surface. In this case, the first and second tapered surfaces may be slidable relative to each other so that actuation of the actuator results in a transmission of the actuator's movement in the first direction into the at least one spring member's movement in the second direction.

The at least one spring member preferably comprises a straight section oriented radially within a space of the frame, the engagement portion being formed at the radially outer end section of the straight section, and the straight section preferably being connected to one or more truss elements of the frame. The straight section is preferably connected to the frame by a plurality of bent elements that bias the engagement portion towards an engaged position. The engaged position is a position that will result in engagement with the backup pad, when the backup pad is attached to the attachment hub.

The at least one spring member may comprise a plastic material or may be made thereof. A suitable plastic material may be polyamide, polypropylene, ABS, HDPE, acetal, polyester and/or any combination thereof.

In an inventive attachment hub, the hub portion, the at least one spring member and the frame may be integrally formed, optionally from a plastic material. A suitable plastic material may be selected from the plastic materials mentioned above with respect to the spring member. Alternatively or additionally, the spring member may be made from a metal material In an inventive attachment hub, the at least one spring member preferably comprises several spring members, with each of the spring members preferably extending in a radial direction from a radially inner portion to a radially outer portion and preferably having the engagement portion arranged at the radially outer portion, wherein each engagement portion is configured for engagement with the counterpart, and wherein the spring members are preferably evenly circumferentially distributed.

Another sander accessory according to the invention is a backup pad having a disc-like shape and comprising a first major surface and a second major surface, the first major surface configured for direct or indirect attachment of an abrasive disc, and the second major surface configured for facing towards an attachment hub for attachment to a sander. The backup pad comprises a mounting portion for aligned engagement with an attachment hub of a sander. The alignment of the attachment hub and the backup pad may be axially and optionally rotationally. However, it is preferred that only axial alignment is required.

The backup pad may comprise pockets and/or cavities. The pockets and/or cavities may contribute to a reduction of material and thus mass of the backup pad. The reduced mass has the positive effect of reducing vibrations occurring during use and transmitted to the hand and/or arm of a user as compared to an otherwise identical backup pad without the recesses and/or cavities and thus higher mass. Another advantage of the pockets and/or cavities is that they aid in dust extraction by allowing airflow under the elements of the frame of the attachment hub, particularly if the frame of the attachment hub is in the truss configuration, as explained above.

The backup pad may comprise dust extraction holes. When combined with an abrasive disc with corresponding dust extraction holes, the dust extraction holes of the backup pad may contribute to the extraction of dust resulting from sanding. With the dust extraction holes, dust may leave the sanding site through the dust extraction holes, which in turn results in an improved sanding effect due to a cleaner sanding site.

The backup pad may comprise a supporting frame and/or a foam pad. Preferably, the backup pad comprises the supporting frame and the foam pad. The foam pad is preferably located between the first major surface and the supporting frame, and the supporting frame is preferably located between the foam pad and the second major surface, the foam pad preferably providing the first major surface.

The backup pad may further comprise a fastener component for releasable attachment of an abrasive disc. The fastener component may be of any suitable type, e.g., an adhesive and/or at least one component of a hook and loop fastener.

The backup pad may comprise an access for an actuator of the attachment hub, wherein the access is preferably a central through hole. Particularly, the access may be a central through hole configured for receiving an actuator in the form of a button of the attachment hub.

The mounting part of an inventive backup pad is preferably a counterpart to a quick-release attachment assembly. In this case, the mounting part is preferably configured for engaging with the quick-release attachment assembly of an attachment hub. The counterpart preferably comprises one or more recesses, undercuts, a rim, a groove, or any combination thereof, extending at least partially around a circumference of the pad.

The backup pad may additionally and preferably alternatively comprise a quick-release attachment assembly configured for releasable and aligned engagement with a counterpart on the attachment hub. The alignment of the attachment hub and the backup pad may be axially and optionally rotationally. However, it is preferred that only axial alignment is required.

The quick-release attachment assembly of the backup pad may comprise any of the features described above with respect to the quick-release attachment assembly of the attachment hub. Particularly, the quick release attachment assembly of the backup pad may comprise an actuator, wherein actuation of the actuator results in disengagement of the backup pad from the counterpart on the attachment hub.

The actuator of the backup pad preferably comprises a button, wherein the quick-release attachment assembly of the backup pad is adapted to disengage from the counterpart on the attachment hub upon a user pressing the button of the backup pad's actuator.

The quick-release attachment assembly of the backup pad may comprise at least one spring member. The spring member of the backup pad may include an engagement portion configured for engagement with the counterpart on the attachment hub.

The quick-release attachment assembly of the backup pad may be configured for axial coupling with the respective counterpart and the backup pad may comprise one or more protrusions and/or one or more recesses configured for rotational coupling of the backup pad with the attachment hub. Again, the axial and the rotational coupling may be effected by different components of the backup pad. In this case, the one or more protrusions and/or one or more recesses configured for rotational coupling of the backup pad with the counterpart on the attachment hub do not contribute to the axial coupling. Alternatively, the axial and the rotational coupling with the attachment hub may be effected by the same components of the backup pad. In this case, the one or more protrusions and/or one or more recesses configured for rotational coupling of the backup pad with the counterpart on the attachment hub may contribute to the axial coupling.

A sander attachment system according to the invention comprises an attachment hub for attachment to a sander and a backup pad. The backup pad has a disc-like shape and comprises a first major surface and a second major surface, the first major surface configured for direct or indirect attachment of an abrasive disc, and the second major surface configured for facing towards the attachment hub. One of the attachment hub and the backup pad comprises a quick-release attachment assembly configured for releasable and aligned engagement with a counterpart on the other one of the attachment hub and the backup pad. The alignment of the attachment hub and the backup pad may be axially and optionally rotationally. However, it is preferred that only axial alignment is required.

The quick-release alignment and attachment assembly may comprise an actuator, wherein actuation of the actuator results in disengagement of the quick-release alignment and attachment assembly from the counterpart. The quick-release actuator may comprise a button, and additionally or alternatively the quick-release attachment assembly may be adapted to disengage from the counterpart upon a user pressing the button.

The quick-release attachment assembly may be configured for axial coupling with the counterpart. The attachment hub may additionally or alternatively comprise one or more protrusions and/or one or more recesses configured for rotational coupling of the attachment hub with one or more corresponding recesses and/or one or more corresponding protrusions of the backup pad.

The quick-release attachment assembly may comprise at least one spring member. The at least one spring member may comprise an engagement portion configured for engagement with the counterpart. The at least one spring member may be configured for a radially outward movement, the radially outward movement of the at least one spring member causing the quick-release alignment and attachment assembly to disengage from the counterpart.

Actuation of the actuator may result in a movement of the actuator along a first direction resulting in a movement of the at least one spring member in a second direction different from the first direction.

The actuator may comprise a first tapered surface and the at least one spring member may comprise a corresponding second tapered surface that is inversely tapered as compared to the first tapered surface; wherein actuation of the actuator results in a transmission of the actuator's movement in the first direction into the at least one spring member's movement in the second direction via the first and second tapered surfaces.

The first direction is preferably parallel to a rotation axis of the attachment hub. The second direction is preferably a radial direction.

The at least one spring member may be made from a plastic material, preferably from one of the plastic materials already mentioned.

The at least one spring member may comprise several spring members, each of the spring members extending in a radial direction from a radially inner portion to a radially outer portion and having the engagement portion arranged at the radially outer portion, wherein each engagement portion is configured for engagement with the counterpart, and wherein the spring members are evenly circumferentially distributed.

The attachment hub may comprise the counterpart and the backup pad may comprise the quick-release alignment and attachment assembly Preferably, the attachment hub comprises the quick-release alignment and attachment assembly and the backup pad comprises the counterpart.

Preferably, the backup pad of the sander attachment system is in accordance with any one of the backup pads described above. Preferably, the attachment hub of the sander attachment system is in accordance with any one of the attachment hubs described above.

With the sander attachment system according to the invention, the process of changing a first abrasive disc of a sander with a second abrasive disc is easy and quick. The user may easily remove the first abrasive disc mounted to the sander by actuation of the quick-release assembly. This results in removal of the backup pad including the first abrasive disc from the attachment hub. The user may then attach the second abrasive disc, which is attached to second backup pad by attaching the second backup pad to the attachment hub via the quick-release assembly. In some embodiments, the attachment of the backup pad to the attachment hub may be achieved by pushing the backup pad onto the attachment hub, thus causing an engagement of the two parts via the quick-release assembly. Particularly, as with some of the embodiments described above, such pushing may cause the one or more spring members to be temporarily pushed into the disengaged position, followed by their return into the engaged position, thereby causing the engagement. Additionally or alternatively, it may be necessary to actuate the actuator for engagement of the backup pad with the attachment hub.

Exemplary embodiments of the invention are described in the following items:

1. An attachment hub for attachment to a sander, comprising a quick-release attachment assembly configured for releasable, and preferably aligned, engagement with a counterpart of a backup pad particularly for an abrasive disc.
2. The attachment hub of item 1, wherein the attachment hub comprises a hub portion and a frame, the hub portion being adapted for releasable attachment to the sander, the frame having a truss configuration forming an outer perimeter of the attachment hub, and the quick-release attachment assembly being mounted to the frame.
3. The attachment hub of any one of the preceding items, wherein the quick-release attachment assembly comprises an actuator, wherein actuation of the actuator results in disengagement of the attachment hub from the counterpart.
4. The attachment hub of item 3, wherein the actuator comprises a button, and wherein the quick-release attachment assembly is adapted to disengage from the counterpart upon a user pressing the button.
5. The attachment hub of any one of the preceding items, wherein the quick-release attachment assembly is configured for axial coupling with the counterpart and wherein the attachment hub comprises one or more protrusions and/or one or more recesses configured for rotational coupling of the attachment hub with the counterpart.
6. The attachment hub of any one of the preceding items, wherein the quick-release attachment assembly comprises at least one spring member.
7. The attachment hub of item 6, wherein the at least one spring member comprises an engagement portion configured for engagement with the counterpart.
8. The attachment hub of any one of items 6-7, wherein the at least one spring member is configured for radial movement, wherein radial outward movement of the at least one spring member causes the quick-release attachment assembly to disengage from the counterpart.
9. The attachment hub of any one of items 6-8, wherein the actuator is adapted to be moved along an axial direction and the spring member is adapted to be moved in a radial direction, wherein the movement of the actuator in the axial direction causes the at least one spring member to move in the radial direction.
10. The attachment hub of item 9, wherein the actuator comprises a first tapered surface and the at least one spring member comprises a corresponding second tapered surface that is inversely tapered relative to the first tapered surface, wherein the first and second tapered surfaces are slidable relative to each other so that actuation of the actuator results in a transmission of the actuator's movement in the axial direction into the at least one spring member's movement in the radial direction.
11. The attachment hub of any one of items 6-10, wherein the at least one spring member comprises a straight section oriented radially within a space of the frame, the engagement portion being formed at the radially outer end section of the straight section, and the straight section being connected to one or more truss elements of the frame.

12. The attachment hub of item 11, wherein the straight section is connected to the frame by a plurality of bent elements that bias the engagement portion towards an engaged position.
13. The attachment hub of any one of items 6-12, wherein the at least one spring member comprises a plastic material or is made thereof.
14. The attachment hub of any one of items 6-13, wherein the hub portion, at least one spring member and the frame are integrally formed, optionally from a plastic material.
15. The attachment hub of any one of items 8-14, wherein the at least one spring member comprises several spring members, each of the spring members extending in a radial direction from a radially inner portion to a radially outer portion and having the engagement portion arranged at the radially outer portion, wherein each engagement portion is configured for engagement with the counterpart, and wherein the spring members are evenly circumferentially distributed.
16. A backup pad having a disc-like shape and comprising:
    a first major surface and a second major surface, the first major surface configured for direct or indirect attachment of an abrasive disc, and the second major surface configured for facing towards an attachment hub for attachment to a sander, and
    a mounting portion for aligned engagement with an attachment hub of a sander.
17. The backup pad of item 16, wherein the backup pad comprises recesses and/or cavities.
18. The backup pad of any one of items 16-17, wherein the backup pad comprises dust extraction holes.
19. The backup pad of any one of items 16-18, wherein the backup pad comprises a supporting frame and/or a foam pad.
20. The backup pad of item 19, wherein the backup pad comprises the supporting frame and the foam pad, and wherein the foam pad is located between the first major surface and the supporting frame, and wherein the supporting frame is located between the foam pad and the second major surface, the foam pad preferably providing the first major surface.
21. The backup pad of any one of items 16-20, further comprising a fastener component for releasable attachment of an abrasive disc.
22. The backup pad of any one of items 16-21, further comprising an access for an actuator of the attachment hub, wherein the access is preferably a central through hole.
23. The backup pad of any one of items 16-22, wherein the mounting part is a counterpart to a quick-release attachment assembly.
24. The backup pad of item 23, wherein the counterpart comprises one or more recesses, undercuts, a rim, a groove, or any combination thereof, extending at least partially around a circumference of the pad.
25. The backup pad of any one of items 16-21, wherein the backup pad comprises a quick-release attachment assembly configured for releasable and aligned engagement with a counterpart on the attachment hub.
26. The backup pad of item 25, wherein the quick-release attachment assembly comprises an actuator, wherein actuation of the actuator results in disengagement of the backup pad from the counterpart on the attachment hub.
27. The backup pad of item 26, wherein the actuator comprises a button, and wherein the quick-release attachment assembly is adapted to disengage from the counterpart on the attachment hub upon a user pressing the button.
28. The backup pad of any one of items 25-27, wherein the quick-release attachment assembly comprises at least one spring member, the spring member optionally including an engagement portion configured for engagement with the counterpart on the attachment hub.
29. The backup pad of any one of items 16-28, wherein the quick-release attachment assembly is configured for axial coupling with the respective counterpart and wherein the backup pad comprises one or more protrusions and/or one or more recesses configured for rotational coupling of the backup pad with the attachment hub.

BRIEF DESCRIPTION OF THE DRAWINGS

Specific embodiments of the invention will be described in further detail with reference to the figures.

DETAILED DESCRIPTION OF PREFERRED EMBODIMENTS OF THE INVENTION

Figure 1:
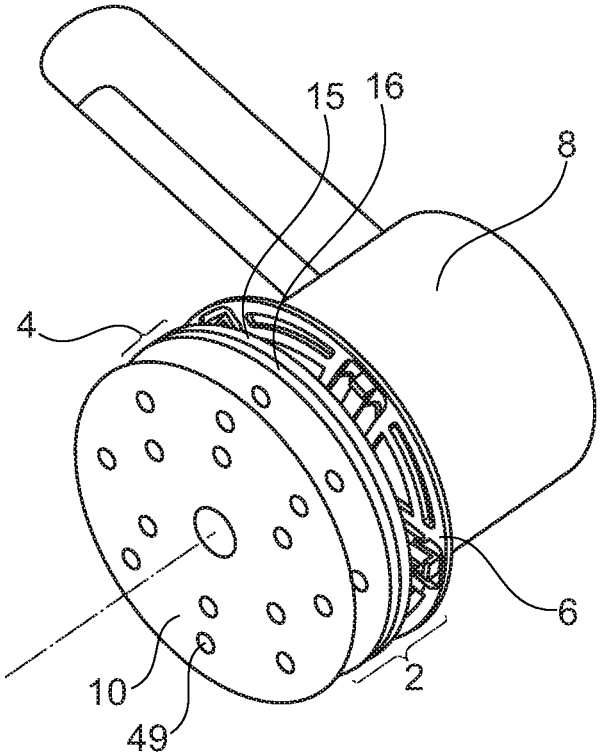
FIG. 1 shows a sander attachment system according to the invention.

FIG. 1 shows a sander attachment system 2 according to the invention. It includes a backup pad 4 and an attachment hub 6 for attachment to a sander 8. The backup pad 4 has a disc-like shape, preferably with an essentially circular circumference, and has a first major surface 6*a* and a second major surface 4*b*. The first major surface 4*a* is configured for facing towards an abrasive disc 10, and the second major surface 4*b* is configured for facing towards the attachment hub 6.

According to the invention, one of the attachment hub 6 and the backup pad 4 comprises a quick-release attachment assembly configured for releasable, and optionally aligned, engagement with the counterpart on the other one of the attachment hub 6 and the backup pad 4. As shown in the embodiment shown in the figures, the attachment hub 6 may comprise the quick-release attachment assembly 12 and the backup pad 4 may comprise a mounting portion 17 for aligned engagement with the attachment hub 6, the mounting portion 17 serving as the counterpart 14 (see also FIGS. 2A and 2B). The dashed line in FIG. 1 indicates a common axis for attachment of the backup pad 4, the attachment hub 6 and the abrasive disc 10 to the sander 8.

Figure 2A:
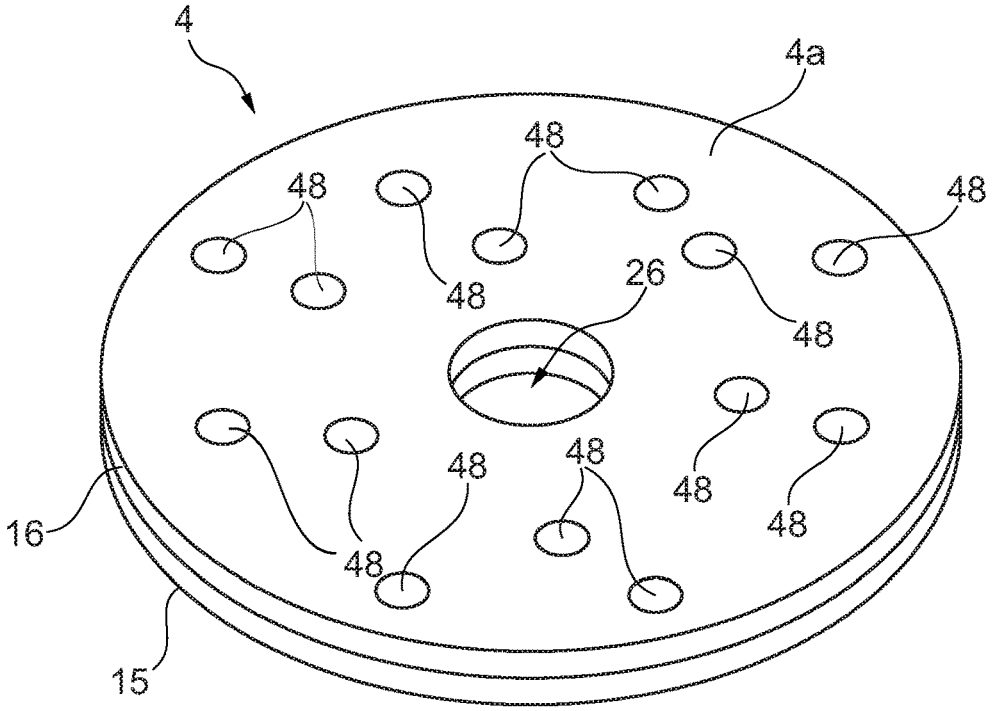
FIG. 2A shows an inventive backup pad from a first side.
Figure 2B:
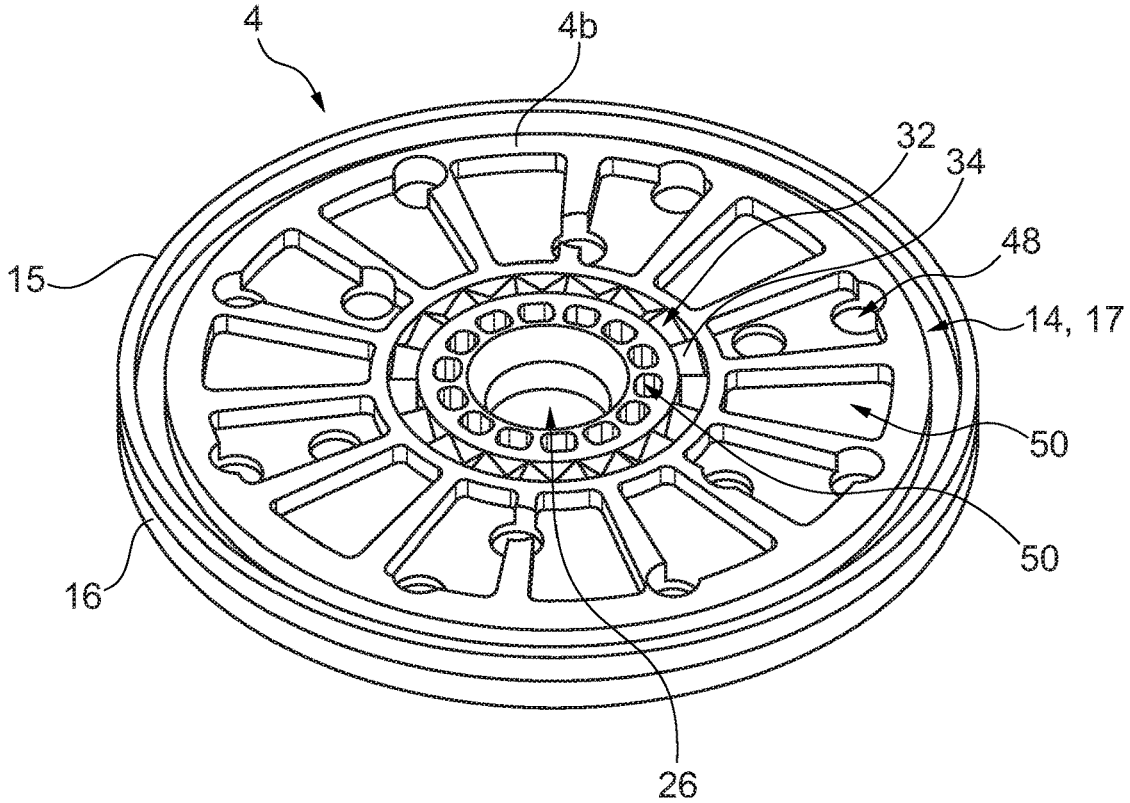
FIG. 2B shows the inventive backup pad of FIG. 2A from a second side.

FIG. 2A shows a first side, i.e. the first major surface 4*a*, of the backup pad 4. FIG. 2B shows a second side, i.e. the second major surface 4*b* opposite to the first major surface 4*a* of the backup pad 4. As shown in FIG. 2B, the backup pad 4 may comprise a supporting frame 15 and a foam pad 16. As shown, the foam pad 16 is preferably located between the first major surface 4*a* and the supporting frame 15 and thus provides the first major surface 4*a*. The supporting frame 15 is preferably located between the foam pad 16 and the second major surface 4*b*.

The backup pad 4 may comprise a fastener component (not shown) for releasable attachment of the abrasive disc 10. The fastener component may be an adhesive, the hooks and/or the loops of a hook and loop fastener, another mechanical fastening system or a component thereof, or any combination thereof.

Figure 4A:
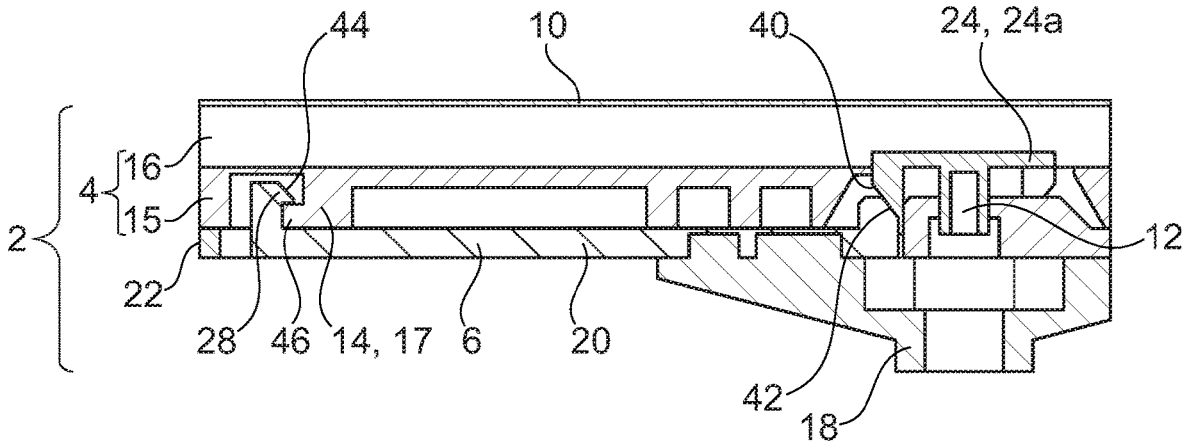
FIG. 4A shows a cross-section of detail of the attachment hub of FIGS. 3A and 3B.
Figure 4B:
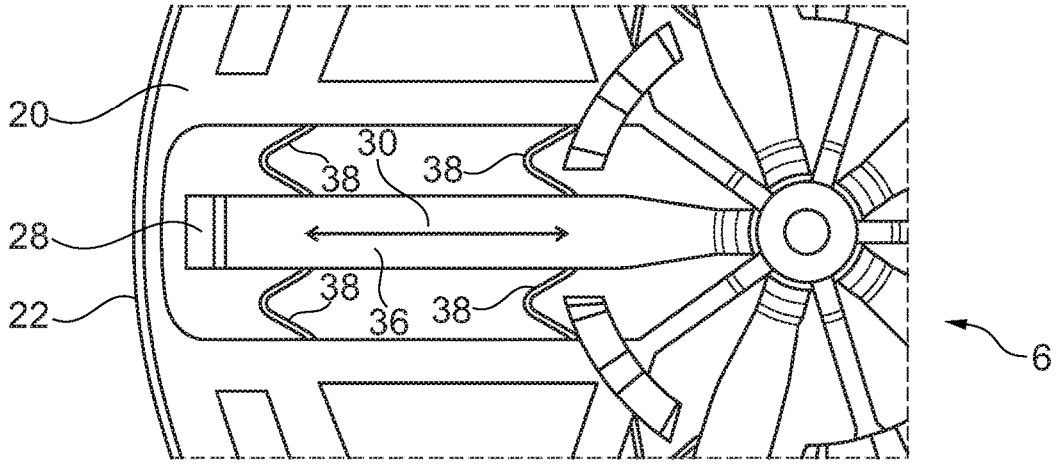
FIG. 4B shows the detail of the attachment hub of FIG. 4A in a top view.

As shown in FIGS. 4A and 4B, the attachment hub 6 may comprise a hub portion 18 and a frame 20. The hub portion 18 is adapted for releasable attachment to the sander 8. As shown, the frame 20 preferably has a truss configuration and forms an outer perimeter 22 of the attachment hub 6. The quick-release attachment assembly 12 is mounted to the frame 20.

In the shown embodiment, the quick-release attachment assembly 12 comprises an actuator 24. Actuation of the actuator 24 results in disengagement of the attachment hub 6 from the counterpart 14.

Preferably, as illustrated in the figures, the actuator 24 comprises button 24*a* and the quick-release attachment assembly 12 is adapted to disengage from the counterpart 14 upon a user pressing the button 24*a*.

As shown in FIGS. 2A and 2B, the backup pad 4 preferably comprises an access 26 for receiving the actuator 24 of the attachment hub 6, or at least a portion of the actuator 24 such as the button 24*a*. When the backup pad 4 is attached to the attachment hub 6, the actuator 24 extends from the side of the second major surface 4B through the backup pad 4 towards and optionally beyond the first major surface 4*a* of the backup pad 4.

As also shown in FIGS. 2A and 2B, the counterpart 14 of the backup pad 4 may be a circumferential undercut. However, it is also contemplated that the counterpart 14 comprises one or more recesses, undercuts, rims, grooves, or any combination thereof, extending at least partially around a circumference of the backup pad 4.

The quick-release attachment assembly 12 comprises an engagement portion 28 configured for engagement with the counterpart 14.

Figure 3A:
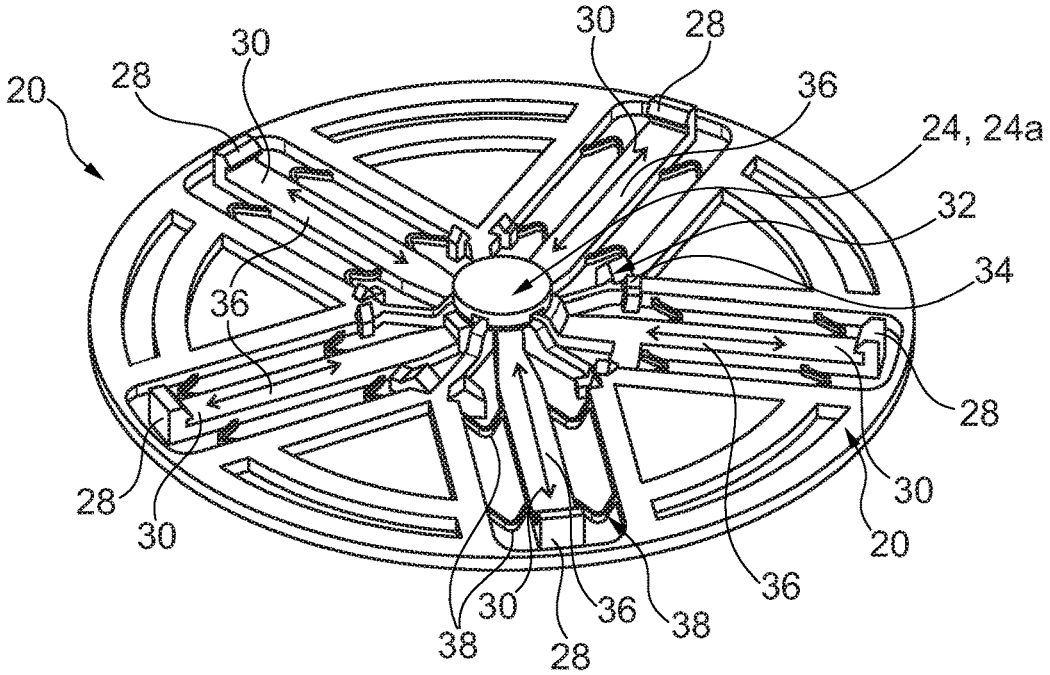
FIG. 3A shows an inventive attachment hub from a first side.
Figure 3B:
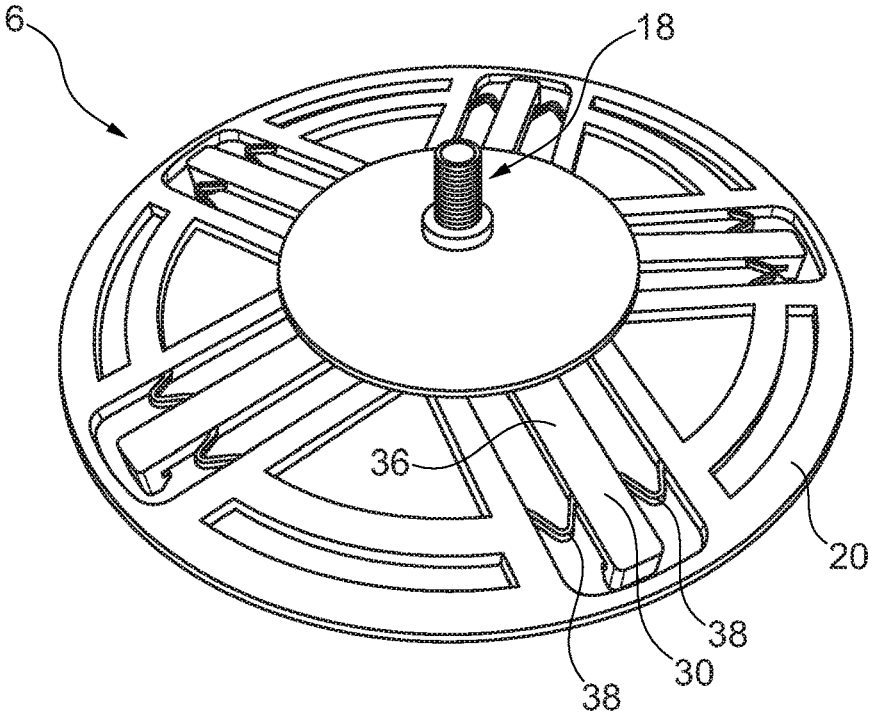
FIG. 3B shows the inventive attachment hub of FIG. 3A from a second side.

As can be seen in FIGS. 3A and 3B, the quick-release attachment assembly 12 preferably comprises at least one spring member 30, and more preferably a plurality of spring members 30. Preferably, each of the at least one spring member 30 comprises an engagement portion 28. Each of the engagement portions 28 corresponds to the respective portion of the counterpart 14, i.e. the mounting portion 17 in the form of an undercut.

Via the engagement between the one or more engagement portions 28 with the counterpart 14 the attachment hub 6 may be coupled with the backup pad 4. This coupling via the counterpart 14 and the one or more engagement portions 28 may be an axial coupling, i.e. the quick-release attachment assembly 12 may be configured for axial coupling with the counterpart 14.

As shown in FIGS. 2A to 3B, the attachment hub 6 may comprise one or more protrusions 32 and/or one or more recesses 34 configured for rotational coupling of the attachment hub 6 with the counterpart 14. The backup pad 4 comprises corresponding recesses 34 and protrusions 32. In the attached configuration, i.e. when the backup pad 4 is attached to the attachment hub 6, the protrusions 32 of the backup pad 4 are engaged with the recesses 34 of the attachment hub 6 and the protrusions 32 of the attachment hub 6 are engaged with the recesses 34 of the backup pad 4. A rotation of the attachment hub 6 during operation of the sander 8 will be transmitted to the backup pad 4 via the protrusions 32 and the recesses 34.

The specific coupling mechanism between the attachment hub 6 and the backup pad 4 may be implemented in a number of different ways. A preferred embodiment is explained with reference to FIGS. 3A to 4B. In the shown embodiment, each spring member 30 comprises a straight section 36 oriented generally radially within a space of the frame 20. The engagement portions 28 are formed at respective radially outer end sections of straight sections 36. Particularly, the straight sections 36 are connected to the frame 20 by a plurality of end elements 38. Preferably, the straight sections 36 are connected to one or more truss elements of the frame 20. Each end element 38 biases the corresponding engagement portion 28 towards an engaged position.

The spring members 30 are configured for radial movement, as indicated by arrows. A radial outward movement of the spring members 30 causes the attached quick-release attachment assembly 12 to disengage from the counterpart 14 such that the attachment 6 and the backup pad 4 may be separated from one another. In this case, the engaged position is radially inward as compared to a release position. However, it is also possible that a radial inward movement of one or more of the spring members 30 causes the attached quick-release attachment assembly 12 to disengage from the counterpart 14. In this case, the engaged position is radially outward as compared to a release position.

Each of the spring members 30 preferably comprises a plastic material or is made of a plastic material. The plastic material may be selected from polyamide, polypropylene, ABS, HDPE, acetal, polyester or any combination thereof. Additionally or alternatively, the hub portion 18 and/or the frame 20 are formed from a plastic material, preferably from the same material as the spring members 30. The hub portion, the at least one spring member 30 and the frame 20 are integrally formed, for example by injection molding.

As shown in FIG. 4A, the actuator 24 may be adapted to be moved along a first direction, such as an axial direction, and the at least one spring member 30 may be adapted to be moved in a second direction, such as a radial direction, wherein the movement of the actuator 24 in the first direction causes the at least one spring member 30 to move in the second direction. Such transmission of the movement of the actuator 24 to the movement of the at least one spring member 30 may be achieved in several different ways. A preferred embodiment is shown in FIG. 4A. The actuator 24 comprises a first tapered surface 40 and each of the spring members 30 comprises a corresponding second tapered surface 42. The second tapered surface 42 is inversely tapered relative to the first tapered surface 40. The first and second tapered surfaces 40, 42 are slidable relative to each other and oriented such that actuation of the actuator 24 results in a transmission of the actuator's movement in the axial direction into the at least one spring member's movement in the radial direction. Particularly, pushing the actuator 24 in a downward direction in FIG. 4A causes the first tapered surface 40 to slide along the second tapered surface 42, thereby pushing on the second tapered surface 42 in a radially outward direction, which results in a radially outward movement of the second tapered surface 42 (to the left in FIG. 4 a). As the second tapered surface 42 is a surface of the spring member 30, the spring member 30 including the engagement portion 28 moves radially outward towards the disengaged position.

Hence, the backup pad 4 may be removed from the attachment hub 6 by actuation of the actuator 24, which results in a movement of the spring members 30 and the engagement portions 28 into the disengaged position. The backup pad 4 including the abrasive disc 10 may then be removed. The same backup pad 4 or another backup pad 4 may be attached to the attachment hub 6 by pushing the backup pad 4 in the correct orientation onto the attachment hub 6 and simultaneously pressing actuating the actuator to move the spring members 30 into the disengaged position. After having the backup pad 4 placed on the attachment hub 6, the actuator 24 may be actuated such that the spring members 30 and the engagement portions 28 return to the engaged position. This causes the engagement of the attachment hub 6 with the backup pad 4. Alternatively or additionally, each spring member 30, preferably each engagement portion 28, may comprise one or more third tapered surfaces 44 and the counterpart 14 may comprise a fourth tapered surface 46 corresponding to the third tapered surface(s) 44. The working principle is analogous to the first and second tapered surfaces 40, 42. Pushing the backup pad 4 against the attachment hub causes the fourth tapered surface(s) 46 to push against the third tapered surfaces 44. This causes third tapered surfaces 44 and thus the spring members 30 to move into the disengaged position until the third and fourth surfaces 44, 46 have passed each other and the spring members 30 return into the engaged position, thus causing the backup pad 4 to snap into engagement with the attachment hub 6.

The backup pad 4 is shown to comprise dust extraction holes 48 extending from the first major surface 4*a* through the backup pad to the second major surface 4*b*. The dust extraction holes 48 contribute to removal of dust generated during sanding of an object with the inventive system. For the dust extraction holes 48 to be effective, they are preferably configured for alignment with corresponding dust extraction holes 49 on the abrasive disc 10.

As shown in FIG. 2B, the backup pad 4 may comprise one or more pockets or cavities 50. The cavities 50 are preferably arranged in the supporting frame 15 and contribute to a reduction of mass of the backup pad 4. The reduced mass of the backup pad 4 contributes to a reduction of load transferred to the hand and arm of a user. The open truss configuration of the frame and spring member(s) of the attachment hub and the cutouts in the backup pad aid in dust extraction and require no rotational alignment of the backup pad with the frame.

The invention claimed is:

1. An attachment hub for attachment to a sander, comprising a quick-release attachment assembly configured for releasable and aligned engagement with a counterpart of a backup pad particularly for an abrasive disc, wherein the quick-release attachment assembly comprises at least one spring member comprising an engagement portion configured for engagement with the counterpart, the at least one spring member extends in a radial direction from a radially inner portion to a radially outer portion and having the engagement portion arranged at the radially outer portion; wherein the at least one spring member comprises a straight section oriented radially within a space of a frame, the engagement portion being formed at the radially outer end section of the straight section, and the straight section being connected to one or more truss elements of the frame, wherein the straight section is connected to the frame by a plurality of biasing elements that bias the engagement portion towards an engaged position.

2. The attachment hub of claim 1, wherein the attachment hub comprises a hub portion and a frame, the hub portion being adapted for releasable attachment to the sander, the frame having a truss configuration forming an outer perimeter of the attachment hub, and the quick-release attachment assembly being mounted to the frame.

3. The attachment hub of claim 1, wherein the quick-release attachment assembly comprises an actuator, wherein actuation of the actuator results in disengagement of the attachment hub from the counterpart, wherein optionally the actuator comprises a button, and wherein the quick-release attachment assembly is adapted to disengage from the counterpart upon a user pressing the button.

4. The attachment hub of claim 1, wherein the quick-release attachment assembly is configured for axial coupling with the counterpart and wherein the attachment hub comprises one or more protrusions and/or one or more recesses configured for rotational coupling of the attachment hub with the counterpart.

5. The attachment hub of claim 1, wherein optionally: the at least one spring member is configured for radial movement, wherein radial outward movement of the at least one spring member causes the quick-release attachment assembly to disengage from the counterpart, and/or the actuator is adapted to be moved along an axial direction and the spring member is adapted to be moved in a radial direction, wherein the movement of the actuator in the axial direction causes the at least one spring member to move in the radial direction, wherein further optionally the actuator comprises a first tapered surface and the at least one spring member comprises a corresponding second tapered surface that is inversely tapered relative to the first tapered surface, wherein the first and second tapered surfaces are slidable relative to each other so that actuation of the actuator results in a transmission of the actuator's movement in the axial direction into the at least one spring member's movement in the radial direction.

6. The attachment hub of claim 5, wherein the hub portion, at least one spring member and a frame are integrally formed, optionally from a plastic material.

7. The attachment hub of claim 1, wherein the at least one spring member comprises several spring members, each of the spring members extending in a radial direction from a radially inner portion to a radially outer portion and having the engagement portion arranged at the radially outer portion, wherein each engagement portion is configured for engagement with the counterpart, and wherein the spring members are evenly circumferentially distributed.

8. An attachment system comprising: a backup pad having a substantial disc shape a disc-like shape and comprising: a first major surface and a second major surface, the first major surface configured for direct or indirect attachment of an abrasive disc, and the second major surface configured for facing towards an attachment hub for attachment to a sander, and a mounting portion for aligned engagement with an attachment hub of a sander; and the attachment hub of claim 1.

9. The backup pad of claim 8, wherein the backup pad comprises the supporting frame and the foam pad, and wherein the foam pad is located between the first major surface and the supporting frame, and wherein the supporting frame is located between the foam pad and the second major surface, the foam pad preferably providing the first major surface.

10. The backup pad of claim 8, further comprising an access for an actuator of the attachment hub, wherein the access is preferably a central through hole.

11. The backup pad of claim 8, wherein the mounting part is the counterpart to the quick-release attachment assembly, wherein the counterpart comprises one or more recesses, undercuts, a rim, a groove, or any combination thereof, extending at least partially around a circumference of the pad.

12. The backup pad of claim 8, wherein the backup pad comprises the quick-release attachment assembly configured for releasable and aligned engagement with the counterpart on the attachment hub, wherein the quick-release attachment assembly comprises an actuator, wherein actuation of the actuator results in disengagement of the backup pad from the counterpart on the attachment hub, wherein optionally the actuator comprises a button, and wherein the quick-release attachment assembly is adapted to disengage from the counterpart on the attachment hub upon a user pressing the button.

13. The backup pad of claim 8, wherein the quick-release attachment assembly is configured for axial coupling with the respective counterpart and wherein the backup pad comprises one or more protrusions and/or one or more recesses configured for rotational coupling of the backup pad with the attachment hub.

* * * * *